US006047792A

United States Patent [19]

Jin et al.

[11] Patent Number: 6,047,792

[45] Date of Patent: Apr. 11, 2000

[54] ELEVATOR HAVING COVERS

[75] Inventors: Hyun Ho Jin, Seoul; Kyoung Woo Park, Kyounggi-Do; Kwang Nam Lee, Inchun-Si, all of Rep. of Korea

[73] Assignee: LG Industrial Systems Co., Ltd., Seoul, Rep. of Korea

[21] Appl. No.: 09/049,116

[22] Filed: Mar. 27, 1998

[30] Foreign Application Priority Data

Mar. 29, 1997 [KR] Rep. of Korea ..... P97-11425
Sep. 13, 1997 [KR] Rep. of Korea ..... P97-47364

[51] Int. Cl.[7] ..... B66B 11/02

[52] U.S. Cl. ..... 187/401; 187/414

[58] Field of Search ..... 187/401, 414, 187/343, 344

[56] References Cited

FOREIGN PATENT DOCUMENTS 50-62267 6/1975 Japan .
3256990 11/1991 Japan .
6329372 11/1994 Japan .

*Primary Examiner*—Kenneth W. Noland

[57] ABSTRACT

Disclosed is an elevator having covers capable of minimizing a generation of turbulent flows at upper and lower portions of the elevator cabin so as to reduce noise and vibration during the operation of the elevator. The elevator according to the present invention comprises upper and lower horizontal supporting members made of shaped steels having a L shape in cross section and plate strips, and covers having a dome and a truncated pyramid shape. In the elevator according to the present invention, the covers can temper impacts, due to air flows in a hoistway, against the elevator cabin during the operation of the elevator. As a result, noise and vibration due to the impacts can be reduced.

17 Claims, 10 Drawing Sheets

CONVENTIONAL ART 10

ELEVATOR HAVING COVERS

BACKGROUND OF THE INVENTION

1. Field of the Invention

The present invention relates to an elevator, and more particularly to an elevator having covers capable of reducing noise and vibration by minimizing a generation of vortex flows at an upper portion and a lower portion of the elevator during movements of the elevator in a hoistway.

2. Description of the Prior Art

In general, an elevator is used for transferring goods or passengers in high rise buildings. High rise buildings have been built up due to the developments of architecture techniques. Thus, elevators which are installed in the high floor buildings, specially elevators for passengers, have been required for operating at high-speed in order to transfer the passengers rapidly.

When the elevator is operated faster than specified speed in the hoistway, air which flows in the hoistway, causes turbulent flow around the elevator, thereby generates substantial noise in an inner space of the elevator.

Japanese Patent laid-open publication No. Hei6-329372, filed by Mashayuki, et al. on Jul. 30, 1993 and published on Nov. 29, 1994, discloses an elevator having a cover mounted on an outer surface thereof.

FIG. 1 is a perspective view of an elevator 10 having a cover according to the invention described in the Japanese patent laid-open publication issued to Mashayuki, et al., and FIG. 2 is a cross-sectional view of the elevator 10 shown in FIG. 1. Referring to FIGS. 1 and 2, the elevator 10 according to the above-mentioned invention includes a fixed supporting body 12 which is connected to a traction means, a cabin 20 for passengers, which is disposed on the supporting body 12 as to be supported by at least one of vibration-absorbing material 14, and a cover 30 which is mounted on the supporting body 12, including tapered sections 32 and 34 at an upper and a lower portions of the cabin 20 and for surrounding sides of the cabin 20 as to cover up tightly the cabin 20.

As described above, in the elevator 10 according to the invention of the above-mentioned publication issued to Mashayuki, et al., the air is made to flow along an outer surface of the cover 30 in hoistway for the elevator by tapering the upper and lower portions of cover 30 surrounding the cabin 20 so that the generation of the turbulent flows, which can create the noise, may be minimized. Furthermore, by providing a space between the cover 30 and the cabin 20, a vibration which is created due to the air flows is prevented from transferring from a wall 36 of the cover 30 to cabin 20.

In the elevator 10 having the cover 30 mounted on the cabin 20 thereof, however, while the air flows through a hole, which is perforated through a top portion of the cover 30 and makes a rope 40 connecting to the elevator 10 extended in order that the traction machine (not shown) moves up and down the elevator 10 in the hoistway, and the space defined between the cover 30 and the cab 20, this can create the turbulent flows. Therefore, there are disadvantages in that the noise and the vibration can be generated by the turbulent flows in the space defined between the cover 30 and the cabin 20 and may be transferred to an inner space of the cabin 20 of the elevator 10.

On the other hand, on an outer upper surface of the cabin 20 of the elevator 10, typically there are mounted an electric motor which generates force to open and close a door, rollers which receive the driving force from a power transmitting mechanism including a shaft and links and is fixed to the door at an end thereof, mechanical apparatus, such as rails, for guiding the rollers to be moved, and electric apparatus, such as a controller, for controlling the electric motor. Such machine and the electric apparatus, which are mounted on the upper portion of the cabin 20, are made to be repaired and periodically maintained by service men.

In the elevator 10 according to the above-described invention, when the machine and the electric apparatus on the cabin 20 are to be repaired or maintained, special tools are required to separate cover 30 from cabin 20, and it takes a long time to remove the cover 30 from cabin 20 since the cover 30 made in one piece surrounds the cabin 20.

Furthermore, to make the cover 30, a high-technical method is required because the cover 30 is large and in one piece with curved portions and flatted portion, thereby increasing the cost of manufacturing the cover 30.

Also special equipments and technique are required to transfer the cover 30, because it is large and in one piece, to a certain building in which the elevator 10 is installed and to surround the cabin 20. Furthermore, it takes a long time to install the cover 30 on the cabin 20.

A buffer generally is disposed on the bottom surface in the hoistway of a building in which the elevator typically moves vertically. In the elevator according to the conventional art, then, there is a problem in that the lowest portion of the cover collides with the buffer. To prevent the cover from colliding with the buffer, it is possible to extend the hoistway downward from the lowest floor of the building. However, there is disadvantages in that time for establishing the building is extended and the cost of installing the elevator is increased.

SUMMARY OF THE INVENTION

The present invention has been made to overcome the above described problems of the prior art. It is a first object of the present invention to provide an elevator in which covers can be easily made, transferred, installed, and repaired more readily than those of the elevator according to the conventional art.

It is a second object of the present invention to provide an elevator having covers which can disperse air, which is introduced into the covers, into a hoistway as to prevent generating of vibrations and noises in a cabin due to the air flow.

It is a third object of the present invention to provide an elevator having cover in order that it is not necessary to form a bottom surface of the hoistway lower than that of the typical hoistway in a building.

To accomplish the above objects the present invention, provides an elevator having a cabin which moves downwardly and downwardly along a hoistway in a building and in which passengers occupy inside thereof, covering means which covers the cabin at a distance from the cabin and has cross section gradually reduced from an upper portion to a lower portion or inverse thereof, and a buffer which is mounted on a bottom surface of the hoistway, the elevator comprising:

a first covering means of which a lower end is mounted on the cabin at a predetermined distance upwardly from an upper surface of the cabin, the first covering means having a largest cross sectional area at the lower end thereof and being possible to be separated into a plurality of pieces; and a second covering means of which an upper end is mounted on the cabin at a predetermined distance downwardly from a lower surface of the cabin, the second covering means having a largest cross sectional area at the upper end thereof and being possible to be separated into a plurality of pieces.

According to the present invention, the elevator further comprises a supporting means for supporting the first and second covering means.

The supporting means includes a pair of horizontal supporting members and a pair of vertical supporting members for supporting the horizontal supporting members as to be respectively spaced apart at the predetermined distance from the upper surface and the lower surface of the cabin.

The supporting means further comprises reinforcing and supporting members for reinforcing a supporting force of the horizontal supporting members.

The horizontal supporting members are made and assembled of L shaped steel strip in cross section as to have a square shape.

The vertical supporting members are steel beams having an U shaped cross section, which is mounted on both side walls of the cabin and of which opposite ends extend at the predetermined distance from the upper and the lower surface of the cabin, respectively.

The reinforcing and supporting members includes a first reinforcing and supporting member of which opposite ends are fixed to the horizontal supporting member and a second reinforcing and supporting member which is fixed to the horizontal supporting member at an end and the vertical supporting member at an other end.

The first and second covering means are empty therein, in which the lower end of the first covering means opens and the upper end of the second covering means also opens.

The first and second covering means have a dome shape.

The first and second covering means have a truncated pyramid shape.

The second cover has an aperture of which a diameter is lager than that of the buffer, at the lower end thereof so that the buffer passes through the aperture.

A height of the second covering means is substantially smaller than that of a portion of the buffer which is inserted into an inner space of the second cover when the cabin generally stops at a lowest floor in the hoistway.

BRIEF DESCRIPTION OF THE DRAWINGS

The above object and other advantages of the present invention will become more apparent by describing in detail the preferred embodiment thereof with reference to the attached drawings, in which:

FIGS. 6A and 6B respectively are detailed perspective views showing the horizontal supporting members of the elevator, in which FIG. 6A shows an upper horizontal supporting member of the elevator and FIG. 6B shows a lower horizontal supporting member of the elevator;

DESCRIPTION OF THE PREFERRED EMBODIMENT

Figure 1:
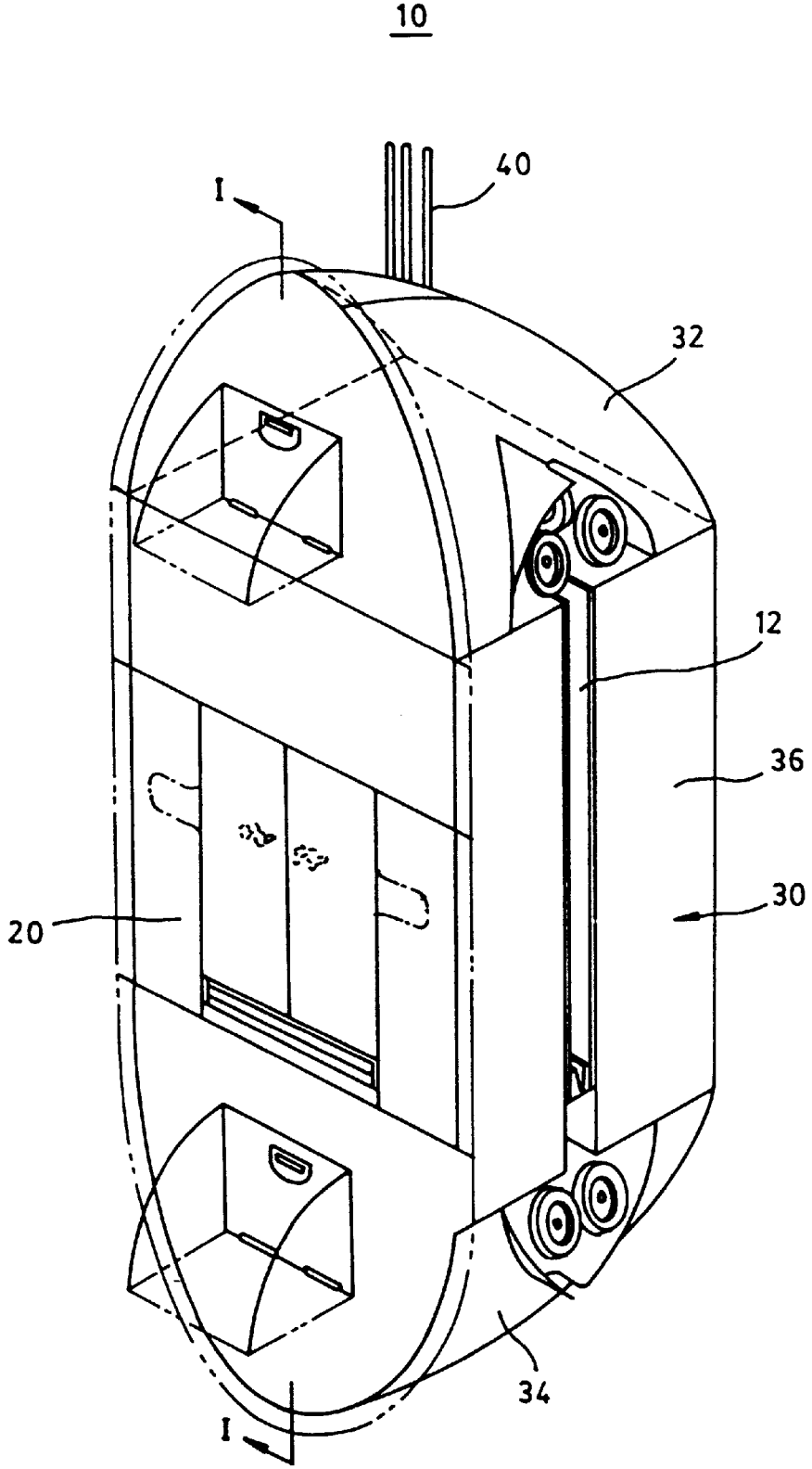
FIG. 1 CONVENTIONAL ART
FIG. 1 is a perspective view of an elevator having a cover according to the conventional art.
Figure 2:
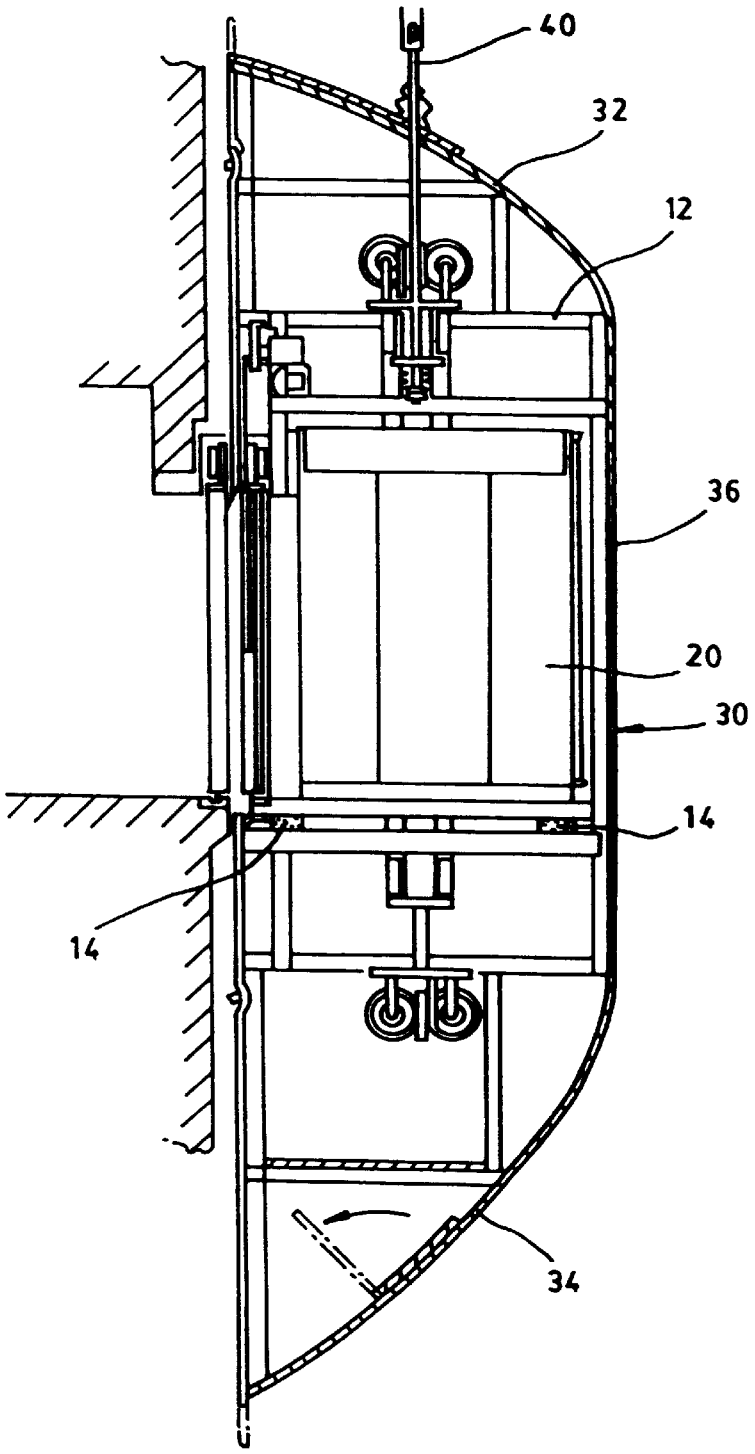
FIG. 2 is a cross-sectional view of the elevator, taken along line I—I in FIG. 1.

Hereinafter, an elevator having covers according to preferred embodiments of the present invention will be described in detail with reference to the accompanying drawings.

In the elevator 100 having a cabin which moves downwardly and downwardly along a hoistway in a building and in which passengers occupy inside thereof, cover which covers the cabin at a distance from the cabin and has cross section gradually reduced from an upper portion to a lower portion thereof, and a buffer which is mounted on a bottom surface of the hoistway, the elevator 100 comprises first covers 120 and 125 of which each lower end is mounted on the cabin 119 at a predetermined distance upwardly from an upper surface of the cabin 119, which have a largest cross sectional area at the each lower end thereof, and which are separated into a plurality of pieces; and second covers 140 and 145 of which each upper end is mounted on the cabin 119 at a predetermined distance downwardly from a lower surface of the cabin 119, which have a largest cross sectional area at each upper end thereof, and which are separated into a plurality of pieces. The elevator 100 further includes a supporting structure 110 to fix and support the first and second covers 120, 125, 140, and 145 to the cabin 119.

Figure 3:
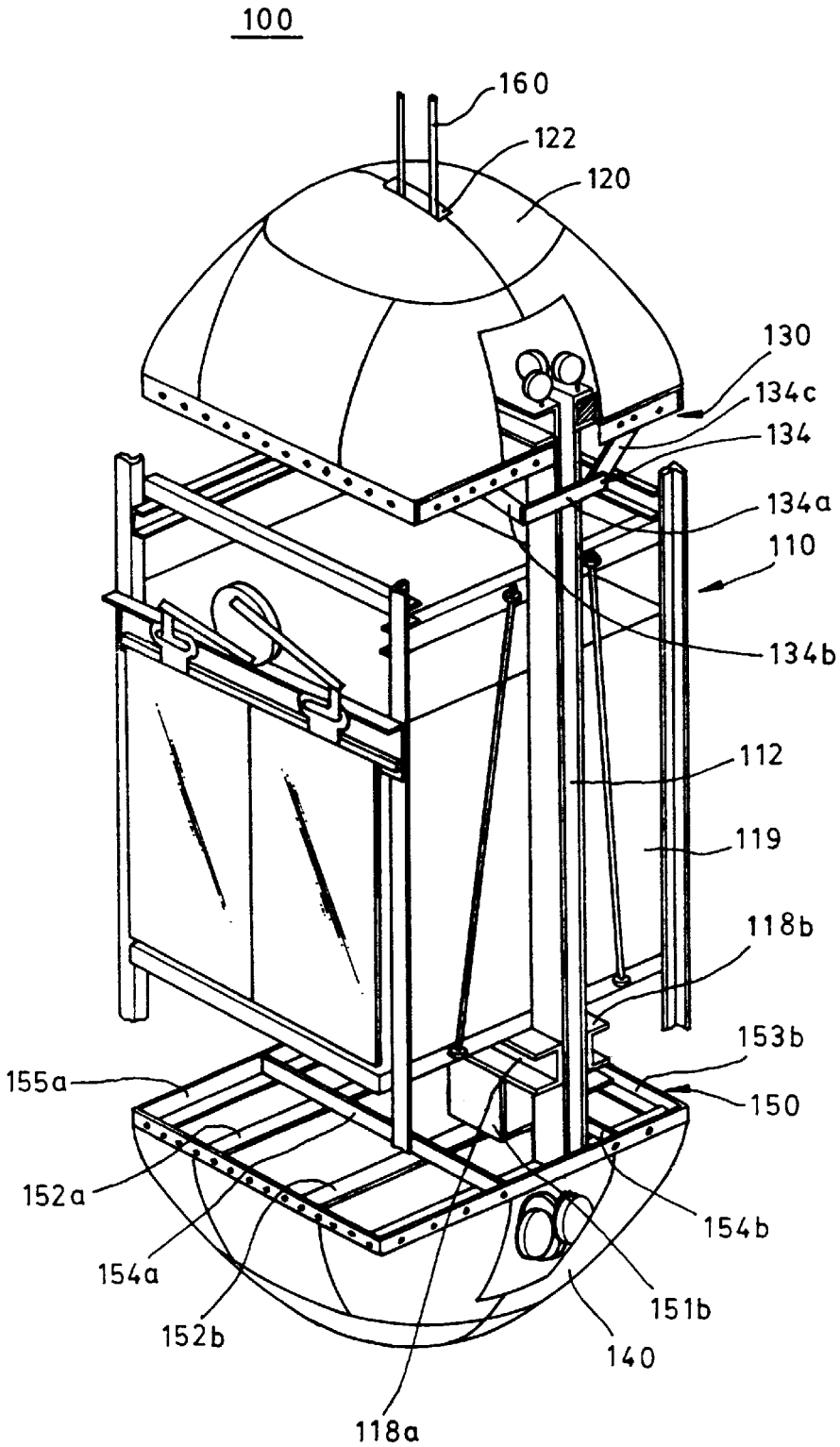
FIG. 3 is a perspective view of an elevator on which the dome shaped cover according to an embodiment of the present invention is mounted.
Figure 4:
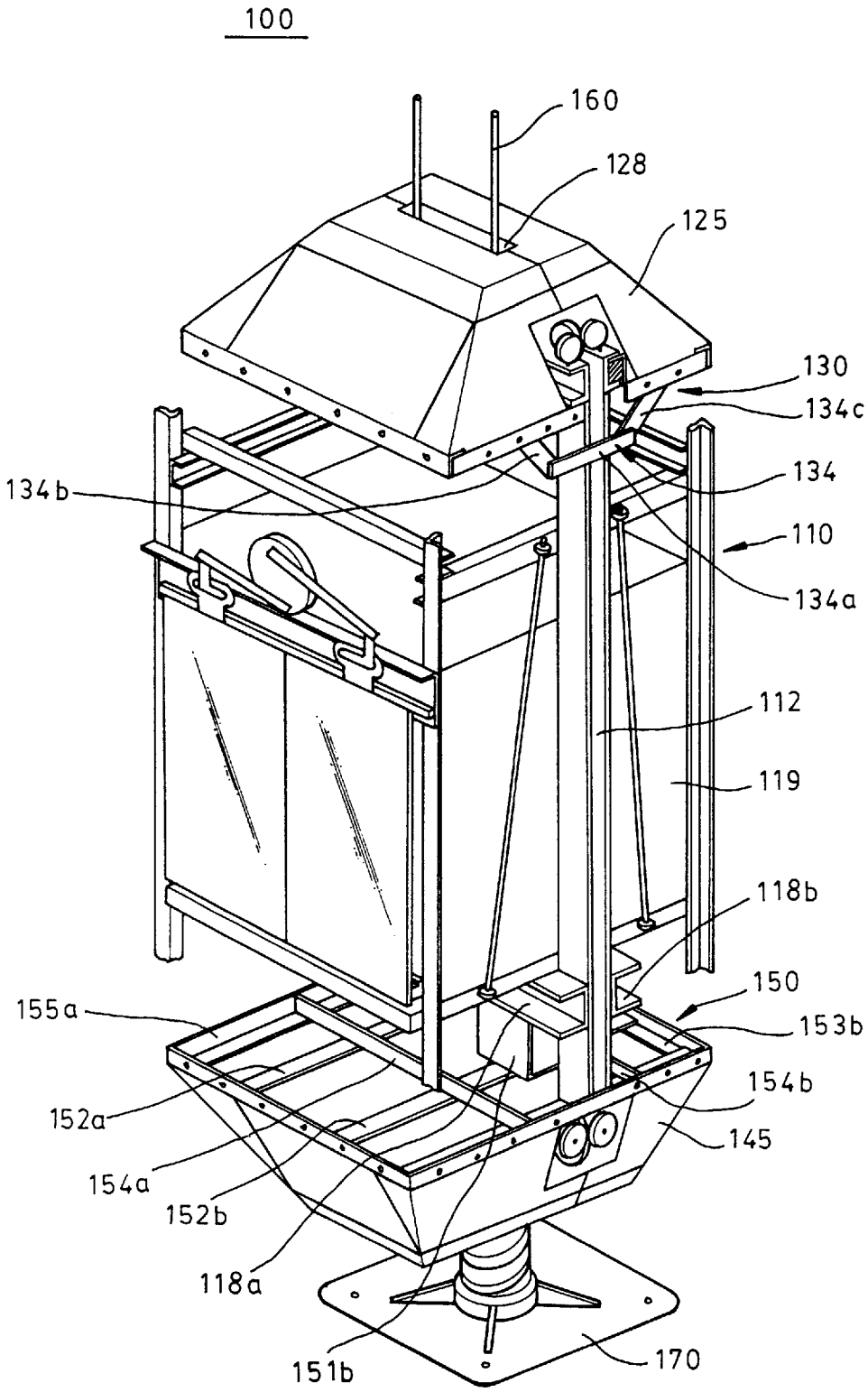
FIG. 4 is a perspective view of the elevator on which the truncated pyramid shaped cover according to the other embodiment of the present invention is mounted.

FIG. 3 is a perspective view of an elevator on which the dome shaped cover according to an embodiment of the present invention is mounted, and FIG. 4 is a perspective view of the elevator on which the truncated pyramid shaped cover according to the other embodiment of the present invention is mounted.

FIGS. 3 and 4, show that the first cover 120 or 125 has the dome shape or the truncated pyramid shape and also the second cover 140 or 145 has the dome shape or the truncated pyramid shape. The first and second covers 120, 125, 140, and 145 are made with a plurality of pieces in order to assemble with each other and to be separated from each other.

The first and second covers 120, 125, 140, and 145 are integrated at each lower end thereof with the upper and lower horizontal supporting members 130 and 150 by using the connecting members, such as bolts and nuts, rivets, and the like.

The first cover 120 or 125 has a thru-hole 122 or 128 formed at a top portion thereof, in which a traction rope 160 extends through the thru-hole 122 or 128. Also, the second cover 140 or 145 has a thru-hole (not shown) formed at a bottom portion thereof, a buffer 170 extends through the thru-hole as to temper impact of the cabin 119 when the elevator 100 passes through the lowest floor of the building. The second cover 140 or 145 is greater in height than that of a portion of the buffer 170 extending through the second cover 140 or 145.

The first and second covers 120, 125, 140, and 145 are empty inside. The first cover 120 or 125 opens at a lower end of which a cross sectional area is largest and the second cover 140 or 145 opens at an upper end of which a cross sectional area is largest.

Figure 5:
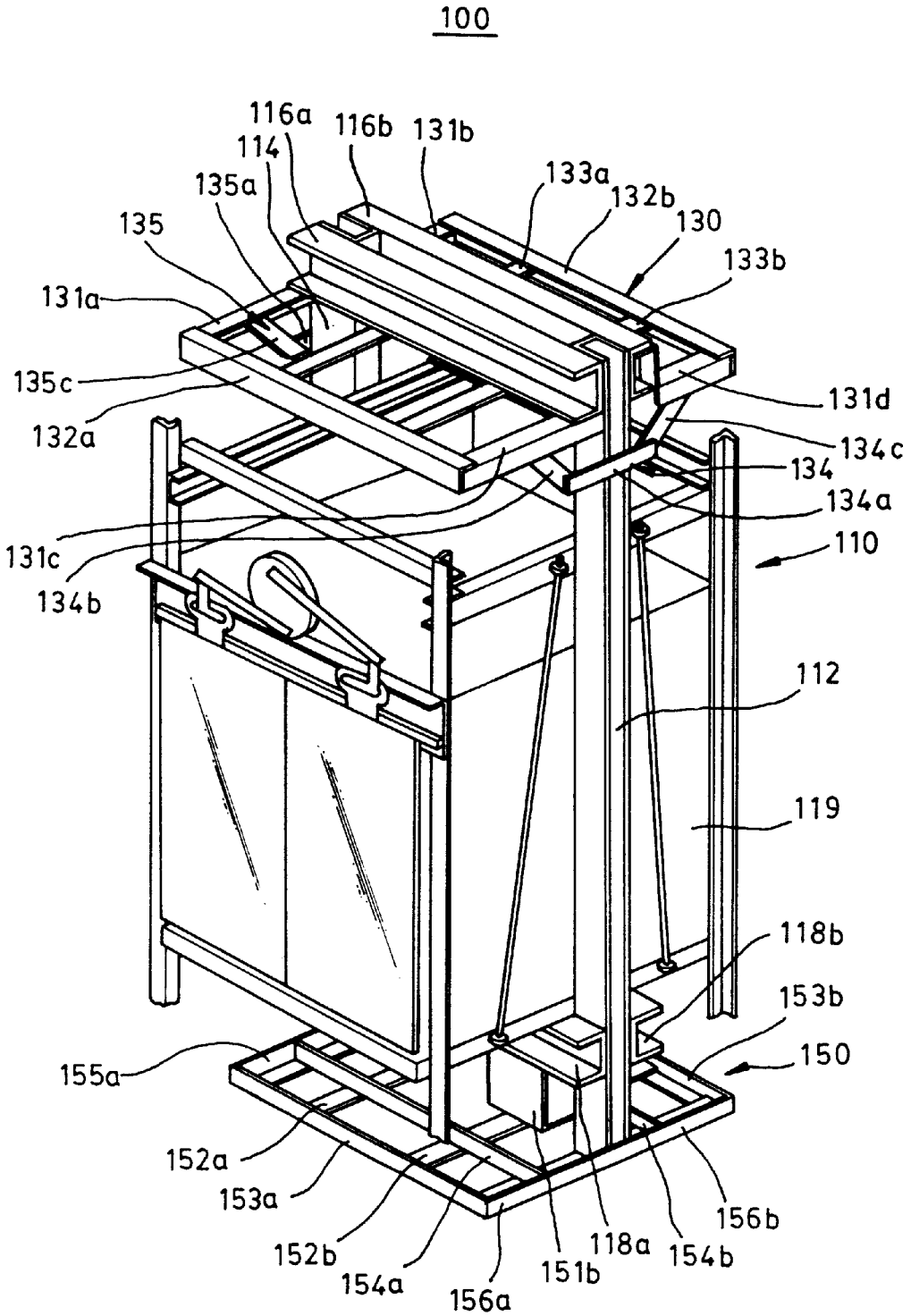
FIG. 5 is a perspective view of the elevator having covers according to the present invention, in which horizontal supporting members are mounted on the elevator and include a dome shaped cover or a truncated pyramid shaped cover disposed thereon.

As shown in FIGS. 3 to 5, the support structure 110 includes a pair of the horizontal supporting members 130 and 150 and a pair of vertical supporting members 112 and 114 for supporting the horizontal supporting members 130 and 150 to be respectively spaced apart from the upper and lower surface of the cabin 119.

The pair of vertical supporting members 112 and 114 are made of steel beams having substantially U shape in cross section and attached to the both side walls of cabin 119 so that bottom surface thereof are opposite to each other. Each upper end of the vertical supporting members 112 and 114 extends upwardly at the predetermined distance from the upper surface of the cabin 119, and each lower end of the vertical supporting members 112 and 114 extends downwardly at the predetermined distance from the lower surface of the cabin 119.

Figure 6A:
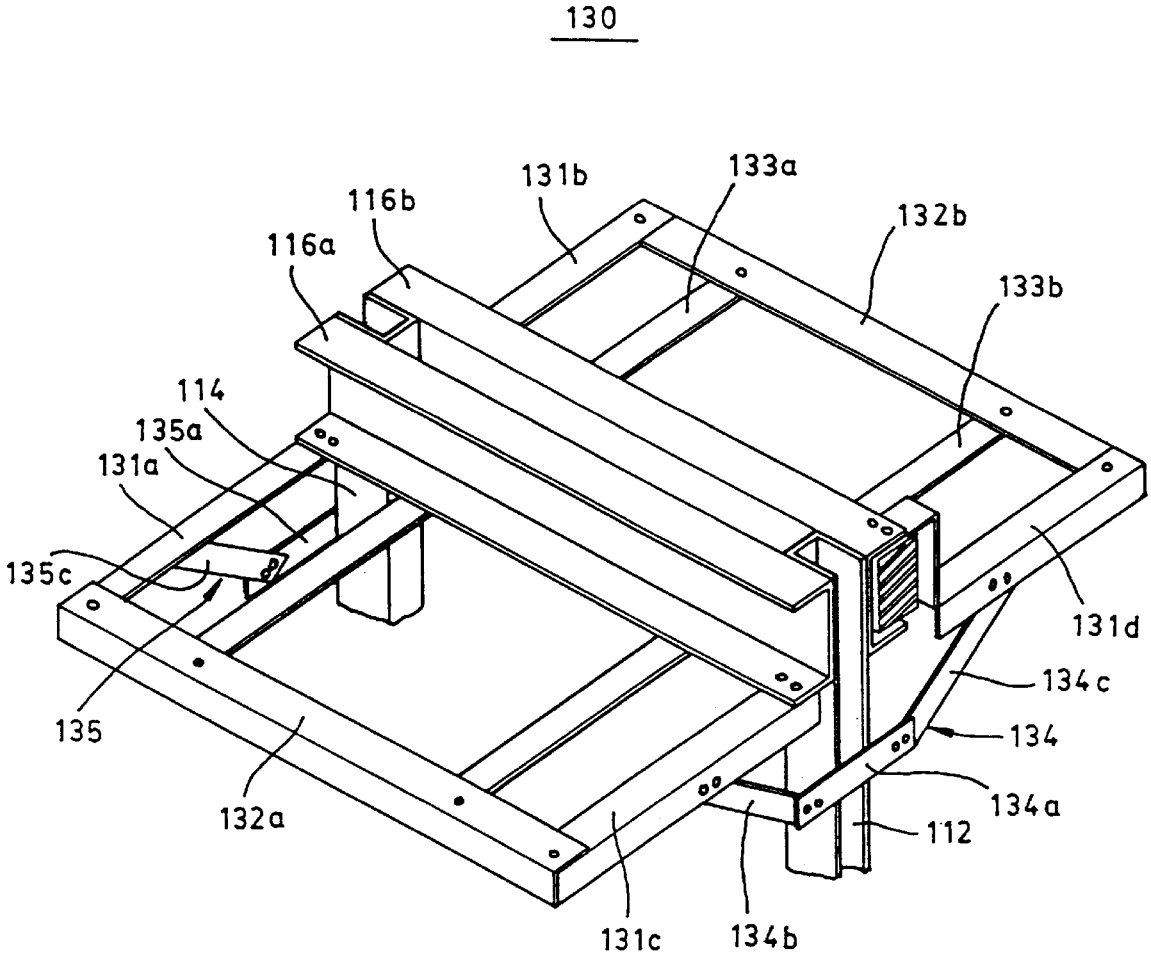

As shown in FIG. 6A, the upper horizontal supporting member 130 comprises cross heads 116*a* and 116*b* which are disposed between the vertical supporting members 112 and 114, for connecting the vertical supporting members 112 and 114 with each other, a plurality of side members 131*a*, 131*b*, 131*c*, and 131*d* of which one ends are connected to the cross heads 116*a* and 116*b* and of which other ends extend externally from the cross heads 116*a* and 116*b*, and at least two of traverse members 132*a* and 132*b* which extend between the other ends of the side members 131*a*, 131*b*, 131*c*, and 131*d* and connect the other ends of the side members 131*a*, 131*b*, 131*c*, and 131*d* with each other.

Both ends of the cross head 116*a* are attached to each of side surfaces at the upper ends of the vertical supporting members 112 and 114 such in a manner of welding, and the like. Also, both ends of the cross head 116*b* are attached to each of other side surfaces at the upper ends of the vertical supporting member 112 and 114 such in the manner as above-described.

The side members 131*a*, 131*b*, 131*c*, and 131*d* and the traverse members 132*a* and 132*b* are made of shaped steels having L shape in cross section and having cut in an appropriated length. The side members 131*a*, 131*b*, 131*c*, and 131*d* all have the same lengths, but one, for example 131*d*, of the side members 131*a*, 131*b*, 131*c*, and 131*d* may be cut in a different length from that of the rest of the side members 131*a*, 131*b*, and 131*c*.

The side members 131*a* and 131*c* are integrated with the cross head 116*a* by connecting each one end of the side members 131*a* and 131*c* on the bottom wall of the cross head 116*a* by means of the bolts and nuts, rivets, and the like, or such in the manner of welding. The side members 131*b* and 131*d* also are integrated with the cross head 116*b* by connecting each one end of the side members 131*b* and 131*d* on the bottom wall of the cross head 116*b* by means of the bolts and nuts, rivets, and the like, or such in the manner of welding.

If a safety device (not shown) is disposed on any one end of both ends of each cross head 116*a* or 116*b*, one of the side members 131*a*, 131*b*, 131*c*, and 131*d* can be cut in the different length from the rest of the side members and then the end of the side member, which is cut, is bent. The bent end of the side member is attached to an upper wall of one of the cross heads 116*a* and 116*b*.

The traverse member 132*a* is disposed between the other ends of the side members 131*a* and 131*c* and of which opposite ends are respectively connected with the each other end of the side members 131*a* and 131*c* by means of the bolts and nuts, rivets, and the like, or in such the manner of welding.

The traverse member 132*b* also is disposed between the other ends of the side members 131*b* and 131*d* and of which opposite ends are respectively connected with the each other end of the side members 131*b* and 131*d* by means of the bolts and nuts, rivets, and the like, or in such the manner of welding.

As shown in FIGS. 5 and 6A, the upper horizontal supporting member 130 further includes a plurality of first reinforcing and supporting members 133*a* and 133*b* for reinforcing and supporting the traverse members 132*a* and 132*b*.

The first reinforcing and supporting members 133*a* and 133*b* are made of plates strips having been cut in the same length as width between the traverse members 132*a* and 132*b*, and disposed across the cross heads 116*a* and 116*b* at a predetermined distance from each other so that one ends thereof are respectively overlapped on the traverse member 132*a* and the other ends thereof are respectively overlapped on the traverse member 132*b*. Then, the first reinforcing and supporting members 133*a* and 133*b* are connected to the cross heads 116*a* and 116*b* by means of welding. The one ends of the first reinforcing and supporting members 133*a* and 133*b* are connected to the traverse member 132*a* and the other ends to the traverse member 132*b* by means of the bolts and nuts, rivets, and the like, or by welding.

The upper horizontal supporting member 130 further comprises second reinforcing and supporting members 134 and 135 which connect the vertical supporting members 112 and 114 to the side members 131*a*, 131*b*, 131*c*, and 131*d* so as to support the upper horizontal supporting member 130.

As shown in FIGS. 3 to 6A, the second reinforcing and supporting members 134 and 135 include a plurality of plate strips. The second reinforcing and supporting member 134 comprises three of plate strips 134*a*, 134*b*, and 134*c*. The second reinforcing and supporting member 135 also comprises three of plate strips 135*a*, 135*b*, and 135*c*. The first plate strip 134*a* of the second reinforcing and supporting member 134 is attached by welding and the like, to the vertical supporting member 112 of which a position is spaced apart at a desired distance from the side members 131*c* and 131*d* of the upper horizontal supporting member 130. One ends of the second plate strip 134*b* and the third plate strip 134*c* of the second reinforcing and supporting member 134 are respectively connected to each of the side members 131*c* and 131*d* by means of the bolts and nuts, rivets, and the like. The other ends of the second plate strip 134*b* and the third plate strip 134*c* are respectively connected to each of opposite ends of the first plate strip 134*a* by means of the bolts and nuts, rivets, and the like.

The first, second, and third plate strips 135*a*, 135*b*, and 135*c* of the second reinforcing and supporting member 135 also are connected to the vertical supporting member 114 and the side members 131*a* and 131*b* in such a manner as described with reference to the second reinforcing and supporting member 134.

When the dome shaped cover or truncated pyramid shaped cover is disposed on the upper horizontal supporting member 130, by supporting the upper horizontal supporting member 130 by means of the second reinforcing and supporting member 134 and 135, as described above, the upper horizontal supporting member 130 can be prevented from having a slack due to a load of the cover and a self-weight of the upper horizontal supporting member 130.

Figure 6B:
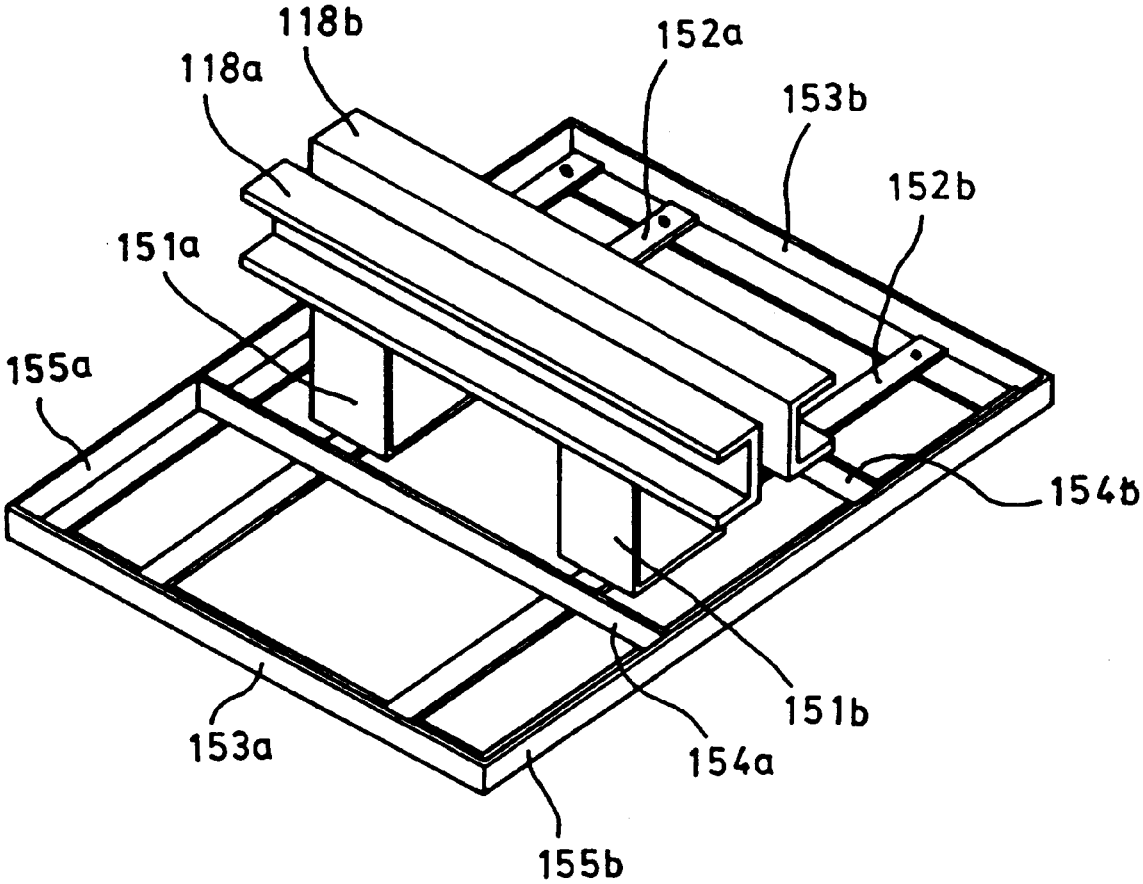

FIG. 6B shows the lower horizontal supporting member 150 of the elevator 100. Referring to FIG. 6B, the lower horizontal supporting member 150 comprises a pair of reinforcing members 118*a* and 118*b* for connecting the vertical supporting members 112 and 114 at the lower portion of the pair of the vertical supporting members 112 and 114, at least two of connecting members 151*a* and 151*b* which are connected and fixed to the reinforcing members 118*a* and 118*b*, main members 152*a* and 152*b* which are attached to each of bottom surfaces of the connecting members 151*a* and 151*b*, and which extend normal to the reinforcing members 118*a* and 118*b* at predetermined distances from the connecting members 151*a* and 151*b* to opposite directions, traverse members 153*a* and 153*b* which are respectively attached to one ends and the other ends of the main members 153*a* and 153*b*, and side members 155*a* and 155*b* of which one connects one end of the traverse member 153*a* to one end of the traverse member 153*b* and of which the other connects the other end of the traverse member 153*a* to the other end of the traverse member 153*b*.

The pair of the reinforcing members 118*a* and 118*b*, which traverse the bottom surface of the cabin 119 of the elevator 100, are disposed on and attached by welding to the vertical supporting members 112 and 114 such that both ends of each of the reinforcing members 118*a* and 118*b* respectively come into contact with each side surface of the vertical supporting members 112 and 114.

The connecting members 151*a* and 151*b* of the lower horizontal supporting members 150 respectively include a bottom wall, side walls which extend upwardly from opposite ends of the bottom wall, and flanges which are interiorly bent at upper portion of each side wall as to be opposite to each other.

The main member 152*a* and 152*b* are made of plate strips which are cut in a predetermined length. The main members 152*a* and 152*b* are respectively attached to the connecting members 151*a* and 151*b* by means of the bolts and nuts, rivets, and the like, or by welding. At this time, the main members 152*a* and 152*b* extend to directions opposite to each other at the same distance from a central axis of the connecting member 151*a* and 151*b*.

The traverse member 153*a* is attached to one ends of the main members 152*a* and 152*b* in such a manner of connecting the one end of the 152*a* to the one end of the 152*b*, while the traverse member 153*b* is attached to the other ends of the main member 152*a* and 152*b* in such a manner of connecting the other end of the 152*a* to the other end of the 152*b*.

Then, the traverse member 153*a* and 153*b* are connected to the one ends and the other ends of the main members 152*a* and 152*b* by means of the bolts and nuts, rivets, and the like, or by welding.

The side members 155*a* and 155*b* and the traverse members 153*a* and 153*b* are made of shaped steels which have L shape in the cross section and are cut in a predetermined length.

As shown in FIG. 6B, the side member 155*a* is disposed between one end of the traverse member 153*a* and one end of the traverse member 153*b* so as to connect the one ends of the traverse member 153*a* and 153*b*, while the side member 155*b* is disposed between the other end of the traverse member 153*a* and the other end of the traverse member 153*b* so as to connect the other ends of the traverse member 153*a* and 153*b*.

The lower horizontal supporting member 150, as constructed as described above, is mounted on the cabin 119 of the elevator 100 in such a manner of connecting the connecting members 151*a* and 151*b* to the bottom of the reinforcing member 118*a* and 118*b* by means of the bolts and nuts, rivets, and the like, or by welding.

The lower horizontal supporting member 150, also includes a first reinforcing and supporting members 154*a* and 154*b* which are adjacent to the connecting members 151*a* and 151*b* and attached to the main members 152*a* and 152*b*. The first reinforcing and supporting members 154*a* and 154*b* are disposed on upper surfaces of the main members 152*a* and 152*b* at a position adjacent to the connecting members 151*a* and 151*b* as to extend across the main members 152*a* and 152*b*. The first reinforcing and supporting members 154*a* and 154*b* are connected to the main member 152*a* and 152*b* by means of the bolts and nuts, rivets, and the like, or by welding.

Also, the lower horizontal supporting member 150 further comprises a second reinforcing and supporting members (not shown) which connect the vertical supporting members 112 and 114 and the side members 115*a* and 115*b* as to reinforce and support the lower horizontal supporting member 150.

Figure 7:
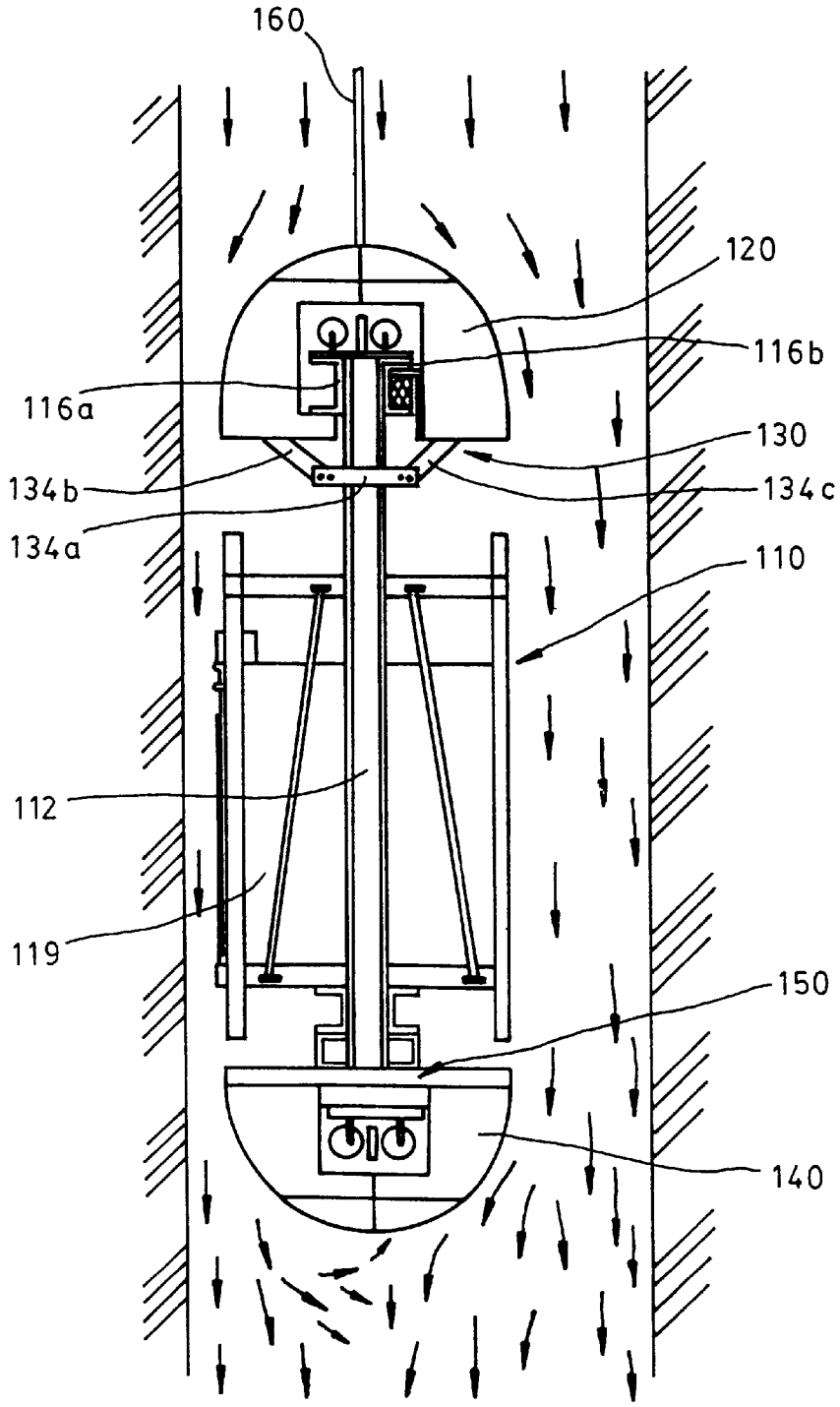
FIG. 7 shows the flow of air in a hoistway while the elevator having the dome shaped cover according to the embodiment of the present invention moves upwardly and downwardly in the hoistway.

FIG. 7 shows the flow of air in a hoistway while the elevator having the dome shaped cover according to the embodiment of the present invention moves in the hoistway. As shown in FIG. 7, the first cover 120 or 125 is disposed on the upper horizontal supporting member 130 at the predetermined distance from the upper surface of the cabin 119 so as to provide a space between the cabin 119 of the elevator 100 and the first cover 120 or 125. Thus, when the elevator 100 moves upward, most of the air flow, which contacts with the first cover 120 or 125, flows along an outer surface of the first cover 120 or 125 downwardly while the rest of air flow is enters the inner space of the first cover 120 or 125 through the thru-hole 122 or 128 perforated at the top portion of the first cover 120 or 125 and smoothly flows along an outer surface of cabin 119 through a space between the first cover 120 or 125 and the upper surface of the cabin 119.

Also, the second cover 140 or 145 is disposed on the lower horizontal supporting member 150 at the predetermined distance from the lower surface of the cabin 119 so as to provide a space between the cabin 119 of the elevator 100 and the second cover 140 or 145. Thus, when the elevator 100 moves downward, most of the air flow, which contacts with the second cover 140 or 145, flows along an outer surface of the second cover 140 or 145 upwardly while the rest of air flow enters the inner space of the second cover 140 or 145 through the thru-hole (not shown) perforated at the bottom portion of the second cover 140 or 145 smoothly flows along an outer surface of cabin 119 through a space between the second cover 140 or 145 and the upper surface of the cabin 119.

Figure 8:
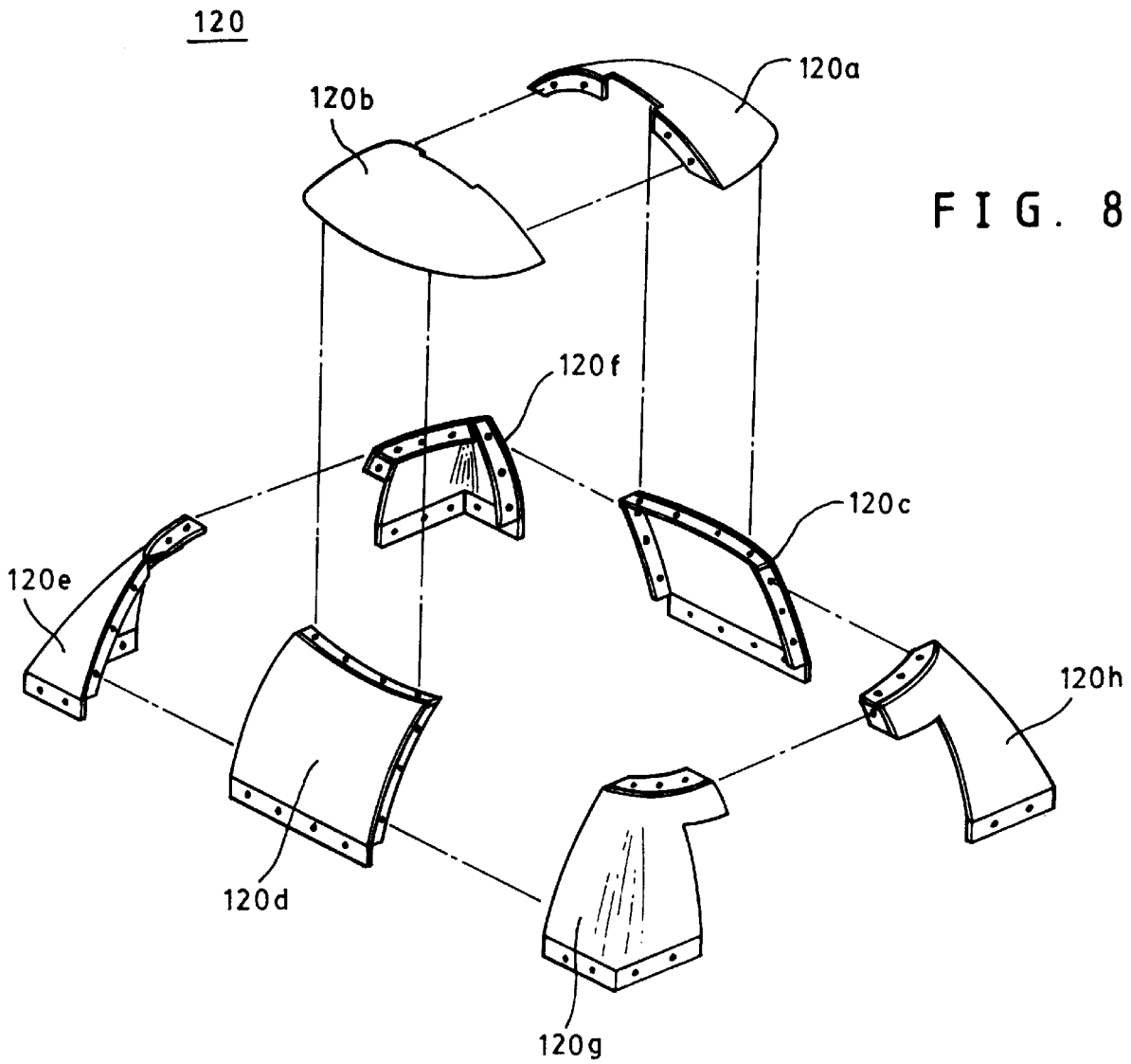
FIG. 8 is an exploded perspective view of the dome shaped cover according to the embodiment of the present invention.
Figure 9:
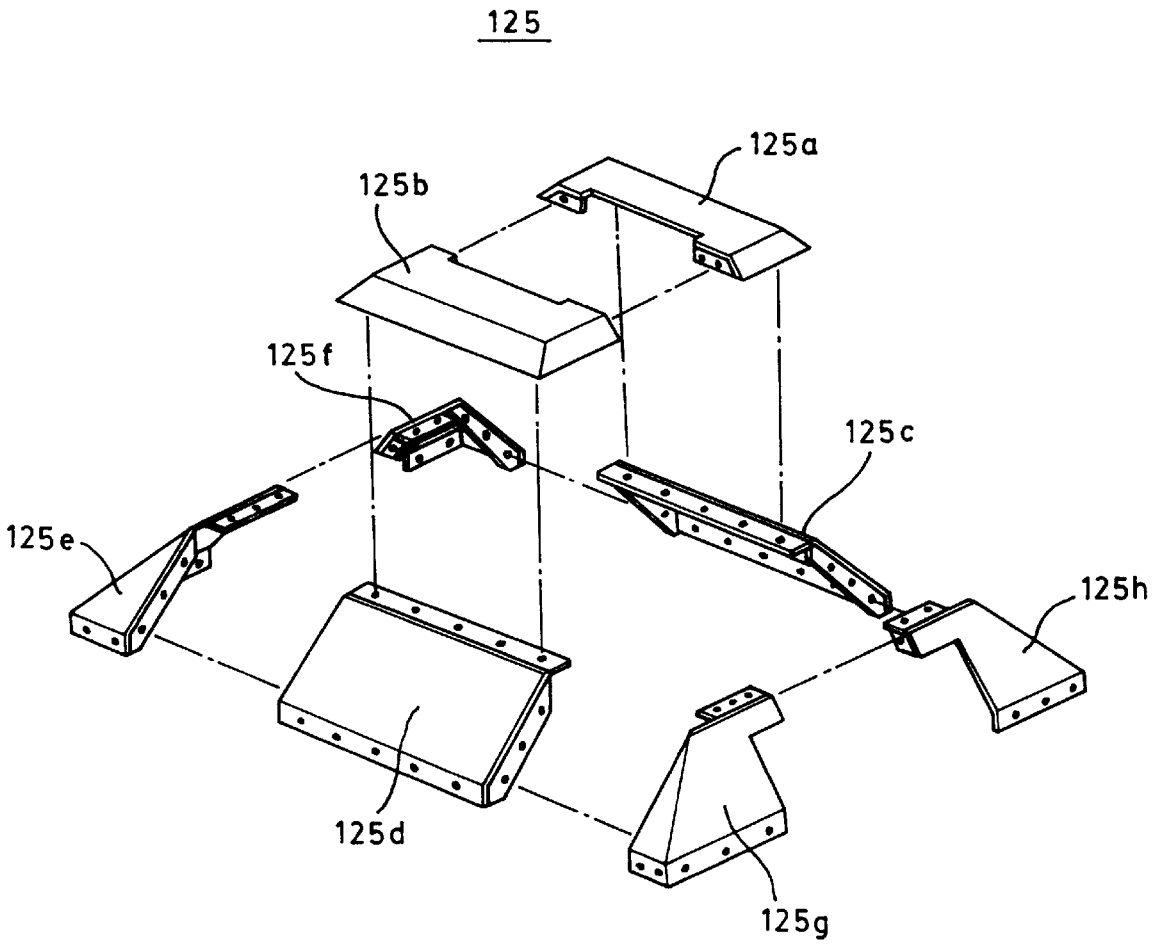
FIG. 9 is an exploded perspective view of the truncated pyramid shaped cover according to the other embodiment of the present invention.

FIG. 8 is an exploded perspective view of the dome shaped cover according to the embodiment of the present invention, and FIG. 9 is an exploded perspective view of the truncated pyramid shaped cover according to the other embodiment of the present invention.

As shown in FIGS. 8 and 9, the dome shaped cover 120 and the truncated pyramid cover 125 are respectively separated into eight pieces, for example in the case of the dome shaped cover, 120*a*, 120*b*, 120*c*, 120*d*, 120*e*, 120*f*, 120*g*, and 120*h*, and in the case of the truncated shaped cover, 125*a*, 125*b*, 125*c*, 125*d*, 125*e*, 125*f*, 125*g*, and 125*h*. The each piece has flanges at edges as to be opposite to the adjacent piece via edges. Thus, when the dome shaped cover 120 or the truncated pyramid cover 125, which has been separated, is mounted on the upper horizontal supporting member 130 and the lower horizontal supporting member 150, the pieces 120*a*, 120*b*, 120*c*, 120*d*, 120*f*, 120*g*, and 120*h* of the cover 120, or the pieces 125*a*, 125*b*, 125*c*, 125*d*, 125*e*, 125*f*, 125*g*, and 125*h* of the cover 125 are disposed on the upper and lower horizontal supporting members 130 and 150 and then the pieces 120*a* and 120*b*, or the piece 125*a* and 125*b*, which form an upper portion of each cover 120 or 125, firstly are combined with each other and in turn the rest of the pieces are combined with each other. Then, lower edges of the cover 120 or 125 are connected to the upper and lower horizontal supporting members 130 and 150.

Furthermore, after connecting the pieces 120*c*, 120*d*, 120*e*, 120*f*, 120*g*, and 120*h*, or the pieces 125*c*, 125*d*, 125*e*, 125*f*, 125*g*, and 125*h* to each other and combining the assembly of the pieces 120*c*, 120*d*, 120*e*, 120*f*, 120*g*, and 120*h*, or the assembly of the pieces 125*c*, 125*d*, 125*e*, 125*f*, 125*g*, and 125*h* with the upper and lower horizontal supporting members 130 and 150, it can be possible to combine the pieces 120*a* and 120*b*, or the pieces 125*a* and 125*b* with the assembly of the pieces 120*c*, 120*d*, 120*e*, 120*f*, 120*g*, and 120*h*, or the assembly of the pieces 125*c*, 125*d*, 125*e*, 125*f*, 125*g*, and 125*h*.

Even though the dome shaped cover and the truncated pyramid shaped cover according to the present invention are respectively separated into eight pieces, as described above, it is possible to adjust numbers of the pieces according to a volume of the elevator and the working site.

As described above, in the elevator having cover according to the present invention, air which is introduced into the cover through the thru-hole at the top portion, is not eddied and flows toward the space defined between the cover and the upper portion of the cabin. The air then flows along an outer surface of the cabin. As a result, this cause the generation of the vortex flow to be distinctively reduced. Therefore, there is an advantage in that the cover according to the present invention generates less the noise than the cover according to the conventional art in which air flows through the space defined between the cabin and thereof.

While the present invention has been particularly shown and described with reference to a particular embodiment thereof, it will be understood by those skilled in the art that various changes in form and detail may be effected therein without departing from the spirit and scope of the invention as defined by the appended claims.

What is claimed is:

1. An elevator having a cabin which moves upwardly and downwardly along a hoistway in a building and in which passengers occupy inside thereof, covering means which covers the cabin at a distance from the cabin and has cross section gradually reduced from an upper portion to a lower portion or inverse thereof, and a buffer which is mounted on a bottom surface of the hoistway, the elevator comprising:

a first cover structure of which a lower end is mounted on the cabin at a predetermined distance upwardly from an upper surface of the cabin, the first cover structure having a largest cross sectional area at the lower end thereof and being separable into a plurality of pieces; and a second cover structure of which an upper end is mounted on the cabin at a predetermined distance downwardly from a lower surface of the cabin, the second cover structure having a largest cross sectional area at the upper end thereof and being separable into a plurality of pieces.

2. An elevator as claimed in claim 1, further comprising a support structure for the first and second cover structures.

3. An elevator as claimed in claim 2, wherein the support structure includes a pair of horizontal supporting members and a pair of vertical supporting members for supporting the horizontal supporting members as to be respectively spaced apart at the predetermined distance from the upper surface and the lower surface of the cabin.

4. An elevator as claimed in claim 2 or claim 3, wherein the support structure further comprises reinforcing and supporting members for reinforcing a supporting force of the horizontal supporting members.

5. An elevator as claimed in claim 3, wherein the horizontal supporting members are made and assembled of L shaped steel strip in cross section as to have a square shape.

6. An elevator as claimed in claim 3, wherein the vertical supporting members are steel beams having an U shaped cross section, which is mounted on both side walls of the cabin and of which opposite ends extend at the predetermined distance from the upper and the lower surface of the cabin, respectively.

7. An elevator as claimed in claim 4, wherein the reinforcing and supporting members includes a first reinforcing and supporting member of which opposite ends are fixed to the horizontal supporting member and a second reinforcing and supporting member which is fixed to the horizontal supporting member at an end and the vertical supporting member at an other end.

8. An elevator as claimed in claim 1, wherein the first and second cover structures are empty therein, the lower end of the first cover structure opens and the upper end of the second cover structure also opens.

9. An elevator car as claimed in claim 1, wherein the first and second cover structures have a dome shape.

10. An elevator as claimed in claim 1, wherein the first and second cover structure have a truncated pyramid shape.

11. An elevator as claimed in claim 1, wherein the second cover structure has an aperture of which a diameter is larger than that of a buffer, at the lower end thereof so that the buffer passes through the aperture.

12. An elevator as claimed in claim 11, wherein a height of the second cover structure substantially is smaller than that of a portion of the buffer which is inserted into an inner space of the second cover when the cabin generally stops at a lowest floor in the hoistway.

13. An elevator, comprising:

a cabin;

an upper cover mounted at a predetermined distance above a top of said cabin; and a lower cover mounted at a predetermined distance below a bottom of said cabin.

14. An elevator of claim 13, wherein a cross section of said upper cover gradually increases from top to bottom.

15. An elevator of claim 13, wherein a cross section of said lower cover gradually increases from bottom to top.

16. An elevator of claim 13, wherein said upper cover comprises a plurality of upper cover members.

17. An elevator of claim 13, wherein said lower cover comprises a plurality of lower cover members.

* * * * *